US006178590B1

(12) United States Patent
Lindsay, III et al.

(10) Patent No.: US 6,178,590 B1
(45) Date of Patent: Jan. 30, 2001

(54) VACUUM CLEANER CANNISTER WITH REMOVABLE BAG

(75) Inventors: Winston S. Lindsay, III, Ponca City, OK (US); Edward W. Lindsay, Jr., New York, NY (US)

(73) Assignee: Lindsay Manufacturing, Inc., Ponca City, OK (US)

( * ) Notice: Under 35 U.S.C. 154(b), the term of this patent shall be extended for 0 days.

(21) Appl. No.: 09/528,932

(22) Filed: Mar. 20, 2000

(51) Int. Cl.[7] ..... A47L 5/36
(52) U.S. Cl. ..... 15/327.1; 15/352; 55/429
(58) Field of Search ..... 15/347, 352, 353, 15/339, 327.1; 55/379, 429

(56) References Cited

U.S. PATENT DOCUMENTS

| | | | | |
|---|---|---|---|---|
| 2,815,621 | * | 12/1957 | Carter | 15/429 X |
| 3,740,933 | | 6/1973 | Hollowell . | |
| 3,755,992 | * | 9/1973 | Ylinen | 55/429 X |
| 3,910,781 | * | 10/1975 | Bryant | 15/352 X |
| 3,961,921 | * | 6/1976 | Heiman et al. | 55/429 |
| 4,523,936 | | 6/1985 | Disanza, Jr. . | |
| 4,575,895 | * | 3/1986 | Spellman | 15/327.1 |
| 4,811,453 | | 3/1989 | Lubraniecki . | |
| 4,838,907 | * | 6/1989 | Perry | 55/429 X |
| 5,129,125 | * | 7/1992 | Gamou et al. | 15/352 |
| 5,145,499 | | 9/1992 | Dyson . | |
| 5,526,547 | | 6/1996 | Williams et al. . | |
| 5,564,155 | | 10/1996 | Monesson . | |

* cited by examiner

*Primary Examiner*—Chris K. Moore
(74) *Attorney, Agent, or Firm*—Wm. Bruce Day

(57) ABSTRACT

A vacuum cleaner has a removable bottom cannister that receives the refuse of the cleaning process. The bottom cannister is fitted with a plate forming an air channel along a portion of the interior side wall of the cannister. When air flows across the top of the air channel, as from cyclonic motion, suction occurs that is used to draw down a liner, or removable bag, against the inside of the cannister and thereby to prevent the liner from floating up and being drawn into the outlet, which would block the operation of the vacuum cleaner. The liner is positioned to receive the refuse and is desirable for reasons of convenience and hygiene during the process of emptying the cannister. In addition, the air channel can be fitted with a clip to aid in the insallation of the liner. The cannister can also be fitted with an interior hood or cone to optimize the flow of air across the top of the air channel.

4 Claims, 2 Drawing Sheets

VACUUM CLEANER CANNISTER WITH REMOVABLE BAG

THE FIELD OF THE INVENTION

This invention relates to central vacuum cleaners, and in particular, to such a vacuum cleaner in which the refuse compartment is adapted for maintaining a disposable bag inside to receive the refuse.

BACKGROUND OF THE INVENTION

This invention enables a vacuum cleaner to use flexible bags as disposable liners for the refuse compartment of the cleaner, similar to the common use of thin-film plastic bags as disposable liners for trash containers. The problem with using such a liner directly in a vacuum cleaner is that the liner or the refuse inside tends to be drawn into the vacuum pump or other parts of the cleaner during operation.

There have been various attempts by other manufacturers to secure such liners inside the refuse compartments so that neither the liners nor their contents are drawn into other parts of the cleaner. Such attempts have included external pressure-equalization tubes, bag weights, reusable magnets, and clips that attach to the bottom of the liner. These attempts have proven to be expensive or inconvenient for the operator of the vacuum. If the operator forgets or otherwise fails to properly attach the liner just one time, the cleaner can be damaged.

A more convenient attempt to hold the liner in place is shown in Lubraniecki, U.S. Pat. No. 4,811,453. This method involves creating a difference in air pressure between the inside and outside of the liner so that the liner is drawn outwards and held in place against porous walls of the refuse compartment. The pressure difference is created by forcing the air used in the cleaning process to flow through a filter, such as the porous filters used in many vacuum cleaners to separate dirt from the air stream. This method requires that the connection to the liner be sealed and that the liner itself be non-porous so that air cannot bypass the filter. It also requires a double wall for the dirt compartment, including a porous inside wall to support the liner. In addition, air ducts are required to connect the liner and the double wall to the filter.

This method suffers from the added expense required for making the more complex refuse compartment and from the problematic clogging of the double wall that can result from a break in the liner or from omitting the liner even one time. The added expense is particularly a problem for vacuum cleaners that use cyclonic dirt separators since an extra filter must be added for this method. In addition, the operator must employ extra care to be sure that the bag seals properly in order for the method to work.

Consequently, there is a need for an inexpensive method of securing a liner inside the refuse compartment of a vacuum cleaner in a manner that is as convenient as placing a liner in a regular trash container and in a manner that will not damage the cleaner in case that the liner breaks or that the liner is not positioned correctly.

SUMMARY OF THE INVENTION

Applicant's invention involves a vacuum cleaner with a standard bottom cannister for receiving the refuse of the cleaning process. The upper portion of the cleaner includes an air intake, a vacuum suction pump, and an air exhaust. A flexible, disposable liner, such as a thin-wall plastic bag, is secured within the bottom cannister so that refuse can be removed in a more hygienic and convenient manner.

The bottom cannister is fitted with a plate that forms an air channel along a portion of the interior side wall of the cannister. The air channel keeps the liner from blocking the flow of air inside the channel. When air flows across the top of the air channel, suction occurs that is used to secure the disposable liner inside the cannister and thereby to prevent the liner from being sucked upwardly into a duct and blocking the operation of the vacuum cleaner. The flow of air across the top of the air channel is caused by an angled inlet to the cleaner that injects air tangentially into the bottom cannister, creating a cyclonic or swirling flow of air. Consequently, the invention is particularly suited for vacuum cleaners that use cyclonic separation rather Man physical filters to separate dirt from the air stream.

The air channel connects the region outside the bottom and the sides of the liner with the lower pressure region that exists along the top inside wall of the dirt cannister. This top region has a lower pressure than the comparatively calm air inside the liner because the air in this top region is moving rapidly in a swirling, or cyclonic, pattern. As a result of the pressure differential between the inside and the outside, the bag expands outward, as desired, to fill the refuse cannister. The lower pressure that results from the faster movement of air is evidence of Bernoulli's Principle, which states that the pressure associated with a stream of fluid (including air) decreases as the speed of the stream is increased.

In addition, the air channel can be fitted with a clip to aid in the installation of the liner and also fitted with a hood or cone to optimize the flow of air across the top of the air channel.

OBJECTS OF THE INVENTION

The objects of the invention are to provide an inexpensive method of securing a liner inside the refuse compartment of a vacuum cleaner in a manner that is as convenient as placing a liner in a regular trash container and in a manner that will not damage the cleaner in case that the liner breaks or that the liner is not positioned correctly. In particular, it is an object of the invention to provide such a method that is easily adapted to vacuum cleaners that use cyclonic separation instead of physical filters to separate refuse from the intake air. Furthermore, it is an objective of the invention to provide such a method that permits the use of porous liners, such as paper bags, in addition to sealed liners, such as plastic bags.

Other objects and advantages of this invention will become apparent from the following description and preferred embodiment of the invention. Other embodiments of the invention will become apparent to one of ordinary skill in the art and the disclosed invention is not limited to the embodiments hereafter following except insofar as set forth in the claims.

DETAILED DESCRIPTION OF THE PREFERRED EMBODIMENT

As required, a detailed embodiment of the present invention is disclosed herein. It is, however, to be understood that the disclosed embodiment is merely illustrative of the invention, which may be embodied in various forms. Therefore, specific structural and functional details disclosed herein are not to be interpreted as limiting, but merely as providing the proper basis for the claims and as a representative basis for teaching one skilled in the art to employ the invention.

Figure 1:
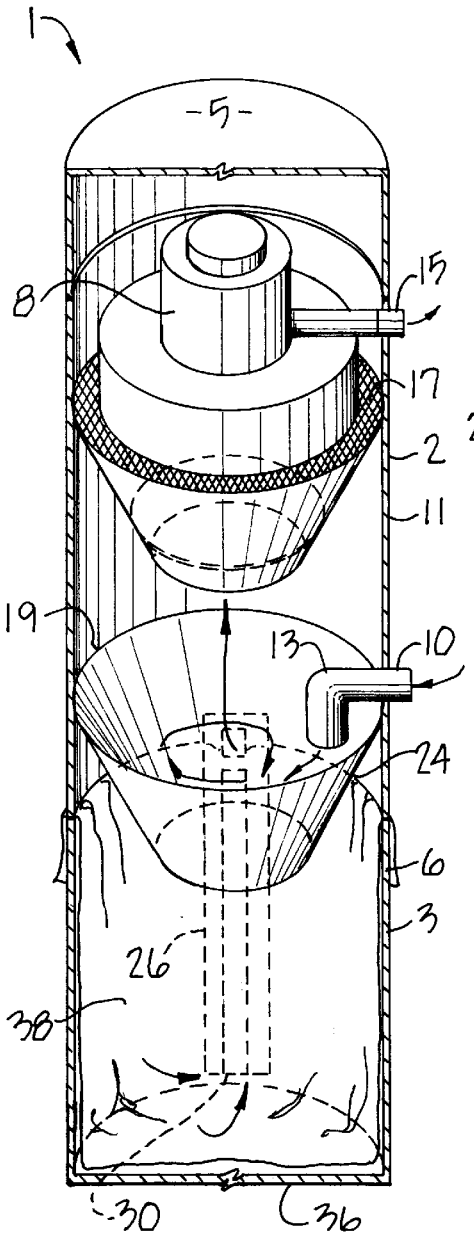
FIG. 1 is a longitudinal sectional view of a vacuum cleaner bottom cannister and motor unit embodying the present invention.

The reference No. 1, FIG. 1 designates a refuse receiving tank in the form of a cannister in that it is cylindrical and has top and bottom sections 2 and 3. The cannister is preferably of metal construction. A typical sized such device is in the nature of 4 feet high and one foot in diameter.

The cannister top section 2 has an upper end 5 and a lower end 6 with a suction blower motor 8 mounted within the top section 2 generally towards the upper end 5. Refuse laden air is brought into the cannister 1 by the suction blower motor 8 through an intake duct 10 of, for example, 2" I.D., extending through the wall 11 of the top section 2 and positioned generally adjacent the lower end 6. The intake duct 10 preferably includes a right angle section 13 opening angularly to the long axis of the cannister 1 so as to direct incoming air in a swirling or cyclonic pattern and deposit airborne laden refuse or debris into the bottom section 3. The motor 8 connects to an exhaust duct 15 extending through the wall 11. An optional electro-static screen 17 fits over the intake of the motor 8 so as to prevent any dust brought in through the intake duct 10 from being sucked through the motor 8 and back out through the exhaust duct 15. At the lower end 6 of the top tank section 2, a cone or funnel 19 is fitted to direct refuse downwardly toward the longitudinal axis of the bottom section 3. The cyclonic air pattern swirls about the cone 19, through its lower opening, and continues in a cyclonic swirling pattern in the bottom section 3. Forty cubic feet per minute of air flow is a normal operating flow for the disclosed vacuum cleaner.

As heretofore described, the above refuse receiving tank with a top section 2 is a standard item of construction made and sold by applicant for many years. Applicant's invention lies in the adaptation to the bottom section 3 as hereinafter described. The bottom section 3, otherwise known as the dirt cannister, has an upper rim 21 which mates with the bottom rim 22 of the overlying top section 2. Clips 23 are connected to the outside of the bottom section 3 adjacent its upper rim 21 and snap over a rolled lip 24 extending from the bottom rim 22. Several exterior clips 23 are circumferentially spaced around the bottom section 3 and hold the top and bottom sections 2 and 3 together. An air channel 26 extends from top to bottom along the inside wall of the dirt cannister 3. The air channel 26 is in the form of a middle channel 27 with left and right wings 25 and 28 extending therefrom. The channel 27 has top openings 29 and bottom openings 30 so as to provide an open air passage from top to bottom. When the air channel 26 is joined to the cannister sidewall, lateral openings 32 form between the wings 25 and 28 ends and the cannister sidewall so that air is pulled laterally there into, forming side air passages. A mounting clip 34 on a tab 33 situated atop the air channel 26 attaches to the bag 38 and keeps the interior of the wall 11 of the dirt cannister 3 to maintain an opening for air flow. The top opening 29 of the air channel 27 terminates substantially even with the upper rim 21 of the dirt cannister 3 and extend the bottom opening 30 is adjacent the bottom 36 of the dirt cannister 3. The bottom opening 30 of the air channel 27 is offset upwardly from the bottom 36 a sufficient distance to allow inward air flow to occur. The channel 26 can be configured in various forms and only one such example is disclosed herein.

Figure 2:
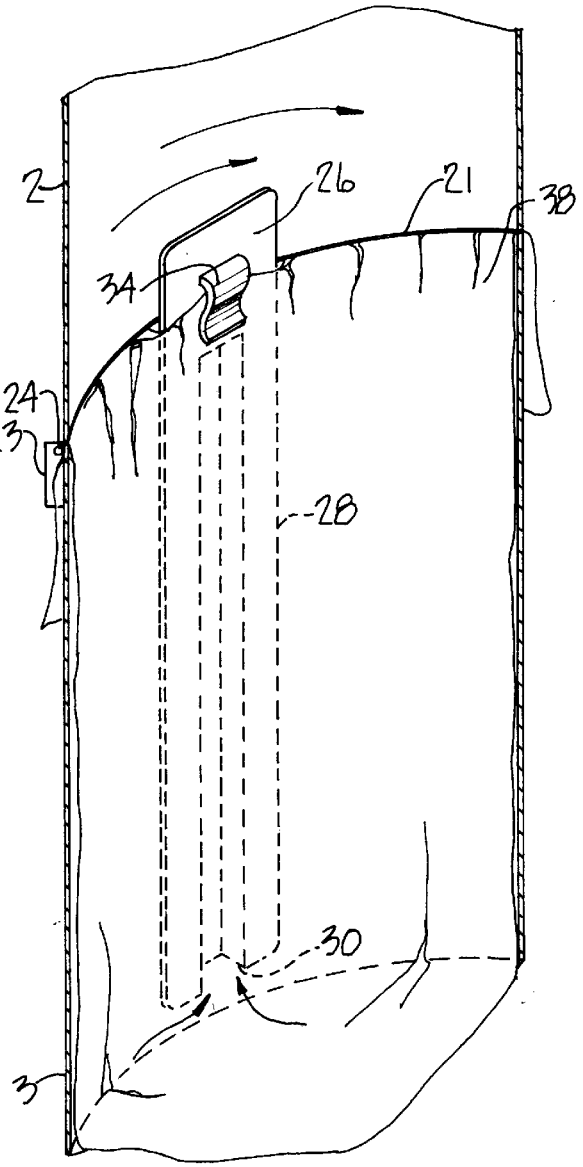
FIG. 2 is an enlarged fragmentary view showing an air channel within the bottom cannister.
Figure 3:
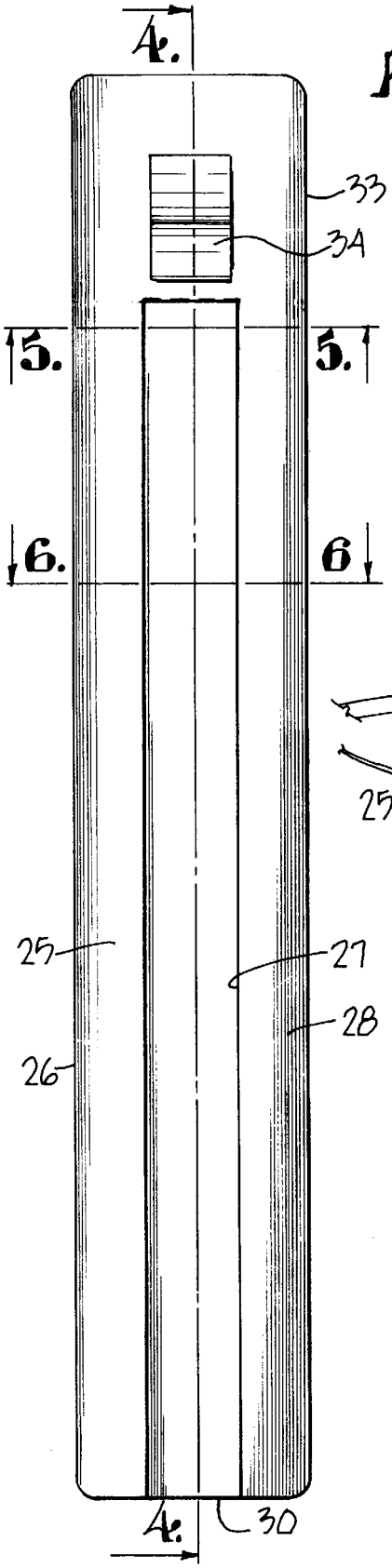
FIG. 3 is an enlarged rear elevation of the air channel.
Figure 5:
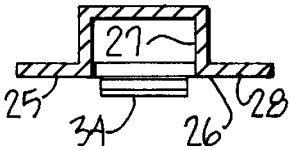
FIG. 5 is a transverse sectional view of the air channel taken along lines 5—5, FIG. 4.
Figure 6:
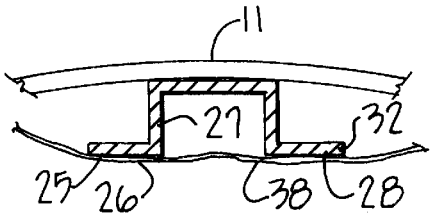
FIG. 6 is a transverse sectional view of the air channel taken along lines 6—6, FIG. 4, and including fragmentary portions of a cannister sidewall and liner bag.
Figure 4:
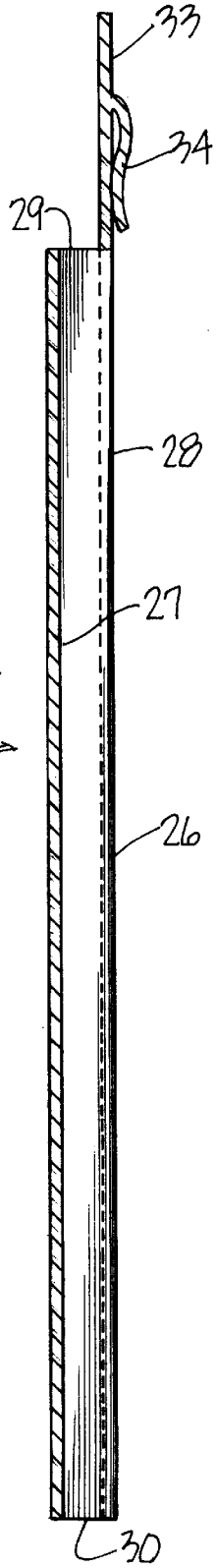
FIG. 4 is a longitudinal sectional view of the air channel taken along lines 4—4, FIG. 3.

A thin film, plastic disposable bag 38 of size corresponding to the size of the dirt cannister 3 is fitted therein with the upper edges of the bag 38 pulled around the tab 33 and folded over the upper rim or end 2, FIG. 2, the dirt cannister 3 is then attached to the top section 2 by the outside clips 23 so that the upper edges of the bag 38 are pulled taut to the outside of the dirt cannister 3.

In operation, the suction blower motor 8 produces a negative pressure below the motor 8 and into the dirt cannister 3. As air is pulled through the inlet 18, it swirls in a cyclonic pattern and over the top openings 29 of the air channel 26, creating a suction effect. Air from the bottom of the cannister 3 is drawn upwardly through the middle channel 28, drawing the bag 38 downwardly. Air is additionally pulled through the lateral openings 32 extending along the length of the middle channel 27 to draw upon the bag 38 and pull the bag sidewall thereagainst, helping to maintain the bag in position.

By the use of the above described invention, a bag 38 can be fitted into the dirt cannister 3 to receive debris coming into the refuse receiving tank. The debris falls through the intake duct 10, through the cone or funnel 19 and into the bag 38. The bag 38 is not drawn upwardly but stays in position while the motor 8 is running. When the bag 38 is full, the dirt cannister 3 is disconnected from the top section 2 and the bag closed, tied off and disposed of. A new bag 38 is installed, the dirt cannister 3 reattached and the device is ready to be used again.

While certain forms of the present invention have been inscribed and illustrated herein, it is not to be limited thereto except insofar as such limitations are included in the following claims.

What is claimed and desired to be secured by Letters Patent is as follows:

1. In a vacuum cleaner consisting of a suction pump with motor, an air intake, an air exhaust, and a refuse receiving cannister with sidewalls and a bottom and located on a bottom of the cleaner, the cannister being open at the top to accommodate a flexible liner bag of sufficient size to fill the cannister, the improvement comprising a channel member extending generally from top to bottom along an interior sidewall of the cannister, the channel member being open at top and bottom and situated between the bag and the cannister sidewall, and the air intake comprising a duct angled obliquely relative to the longitudinal axis of the cannister so that incoming air swirls about the interior of the vacuum cleaner and cannister in a cyclonic pattern inducing a suction through the top of said channel member sufficient to hold the liner bag against the cannister sidewalls and bottom.

2. The improvement set forth in claim 1 wherein the channel member has side openings therealong from top to bottom, which tend to pull the bag tight thereagainst.

3. The improvement set forth in claim 1 including a cone mounted in said cleaner which extends downwardly into said cannister.

4. The improvement set forth in claim 1 wherein said channel member has a clip mounted at the top thereof to affix the bag thereto.

* * * * *